US007308804B2

(12) United States Patent
Onishi et al.

(10) Patent No.: US 7,308,804 B2
(45) Date of Patent: Dec. 18, 2007

(54) DEFROSTING HEATER, AND REFRIGERATOR HAVING THE DEFROSTING HEATER

(75) Inventors: Ichiro Onishi, Shiga (JP); Toshiki Maeda, Kawanishi (JP); Akira Yokoe, Otsu (JP); Kazuyoshi Takeuchi, Kusatsu (JP)

(73) Assignee: Matsushita Refrigeration Company, Shiga (JP)

( * ) Notice: Subject to any disclaimer, the term of this patent is extended or adjusted under 35 U.S.C. 154(b) by 373 days.

(21) Appl. No.: 10/490,301

(22) PCT Filed: Jul. 3, 2002

(86) PCT No.: PCT/JP02/06724

§ 371 (c)(1),
(2), (4) Date: Mar. 19, 2004

(87) PCT Pub. No.: WO03/031890

PCT Pub. Date: Apr. 17, 2003

(65) Prior Publication Data

US 2004/0237560 A1 Dec. 2, 2004

(30) Foreign Application Priority Data

Sep. 8, 2001 (JP) ..... 2001-300687

(51) Int. Cl.
*F25D 21/06* (2006.01)

(52) U.S. Cl. ..... 62/276

(58) Field of Classification Search ..... 62/276, 62/275, 272; 219/541, 553, 523
See application file for complete search history.

(56) References Cited

U.S. PATENT DOCUMENTS 5,552,581 A * 9/1996 Jasper et al. ..... 219/523

FOREIGN PATENT DOCUMENTS

| | | | |
|---|---|---|---|
| JP | 06-147732 | A | 5/1994 |
| JP | 08-054172 | A | 2/1996 |
| JP | 10-232082 | A | 9/1998 |
| JP | 11-257831 | A | 9/1999 |
| JP | 2001-133127 | A | 5/2001 |

OTHER PUBLICATIONS

English translation of International Search Report for PCT/JP02/06724, dated Oct. 29, 2002.
Microfilm of the specification and drawings annexed to the request of Japanese Utility Model Application No. 51025/1989 (Laid-open No. 144385/1990), (Fujitsu General Ltd.), Dec. 7, 1990 and a partial English translation.

* cited by examiner

*Primary Examiner*—Melvin Jones
(74) *Attorney, Agent, or Firm*—RatnerPrestia

(57) ABSTRACT

A defrosting heater in a refrigerator with a flammable refrigerant sealed therein, including a first glass tube (53) having a heater wire (52) inside thereof, a plug (58) covering both end opening parts of the first glass tube (53) and a second glass tube (54), a lead wire (55) piercing the plug (58) and connected to an end of the heater wire (52), and a positioning plate (57) disposed on a connection part of the lead wire (55) with the heater wire (52). Flame propagation can be prevented by setting the size of a space (58*b*) formed by the plug (58) and the positioning plate (59) according to the sealing quantity of the flammable refrigerant and the surface temperature of the heater wire (52), and an unstable state in a defrosting mode is prevented even when the flammable refrigerant leaks.

30 Claims, 13 Drawing Sheets

DEFROSTING HEATER, AND REFRIGERATOR HAVING THE DEFROSTING HEATER

This Application is a U.S. National Phase Application of PCT International Application PCT/JP02/06724.

TECHNICAL FIELD

The present invention relates to a defrosting heater in a refrigerator or the like for removing frost sticking and depositing on a cooler of refrigeration cycle packed with flammable refrigerant, and a refrigerator having such heater.

BACKGROUND ART

FIG. 16 is a sectional view of a conventional refrigerator disclosed in Japanese Laid-open Patent No. H8-54172. A refrigerator main body 1 comprises a freezing compartment 2, a refrigerating compartment 3, and a cooling section 20. The cooling section 20 incorporates an evaporator 10 cooled by circulation of refrigerant, and a defrosting heater 15 having a Nichrome wire coil covered with a glass tube.

A fan 11 sucks air into the cooling section 20 from the freezing compartment 2 and refrigerating compartment 3 through a freezing compartment suction port 7 and a refrigerating compartment suction port 8 for cooling the air by exchanging heat with the evaporator 10. The fan 11 sends the cooled air into the freezing compartment 2 through a diffusion port 9. The cooled air is also distributed into the refrigerating compartment 3 from the freezing compartment 2 through the passage not shown. When the air sucked into the cooling section 20 exchanges heat with the evaporator 10, the moisture in the air is frosted and sticks to the evaporator 10.

Before the frost deposit begins to lower the cooling capacity of the refrigerator, the frost is thawed by applying current to the Nichrome wire of the defrosting heater 15. As the Nichrome wire is energized, heat rays are emitted from the Nichrome wire to the evaporator 10 and peripheral parts through the glass tube. Heat rays emitted to a bottom plate 17 are reflected to peripheral parts including the evaporator 10 and defrosting heater 15. Heat rays thaw the frost deposits on the evaporator 10, a gutter 13 and drain port 14. A roof 16 is provided to protect the defrosting heater 15 from thawing water. The thawing water drops into the gutter 13, and discharged outside of the refrigerator through the drain port 14.

In the conventional constitution, however, the surface temperature of the glass tube of the defrosting heater 15 is always very high temperature. Further, the bottom plate 17 is located near the defrosting heater 15, and part of the heat rays radiated from the defrosting heater 15 are reflected again to the defrosting heater 15, and hence the glass tube temperature rises abnormally high, possibly exceeding the ignition point of the flammable refrigerant.

Hence, when the flammable refrigerant is used, it is an important problem that the defrosting heater 15 should never be source of ignition due to supply of power even if the flammable refrigerant should leak out from the evaporator or the piping installed in the portion communicating with the inside of the refrigerator.

DISCLOSURE OF THE INVENTION

In the light of the above problems, it is hence an object of the invention to present a defrosting heater of high safety even in the case of defrosting in an environment of the flammable refrigerant leaking into the atmosphere of installation of the defrosting heater.

The defrosting heater of the invention is a defrosting heater for heating and removing frost deposits on the cooler in the refrigeration cycle packed with a flammable refrigerant, comprising a glass tube, a heater wire of metal resistance element installed in the glass tube, a plug covering both end openings of the glass tube, a lead wire penetrating through the plug and connected to the end of the heater wire, and a positioning plate disposed at the junction of the heater wire and lead wire and held by the plug for preventing the junction from moving, in which the size of the gap formed between the plug and the positioning plate is set depending on the packing amount of the flammable refrigerant, and therefore if the flammable refrigerant passes through the gap formed between the plug and the positioning plate and invades into the heater wire side and is ignited, the gap formed between the plug and the positioning plate is set in a size not to allow the flame to propagate, so that the safety is guaranteed.

DETAILED DESCRIPTION OF THE PREFERRED EMBODIMENTS

Figure 1:
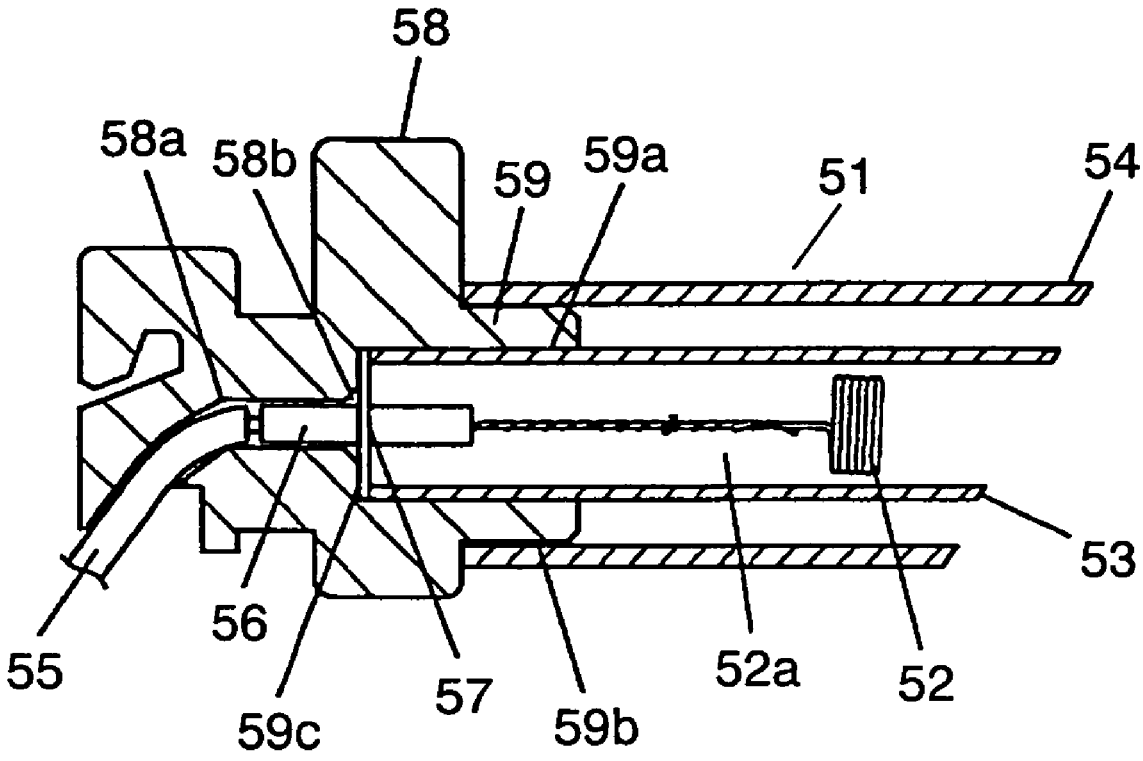
FIG. 1 is an essential sectional view of a defrosting heater in a first embodiment of the invention.

Referring now to the drawings, preferred embodiments of the invention are described specifically below.

First Embodiment

Figure 2:
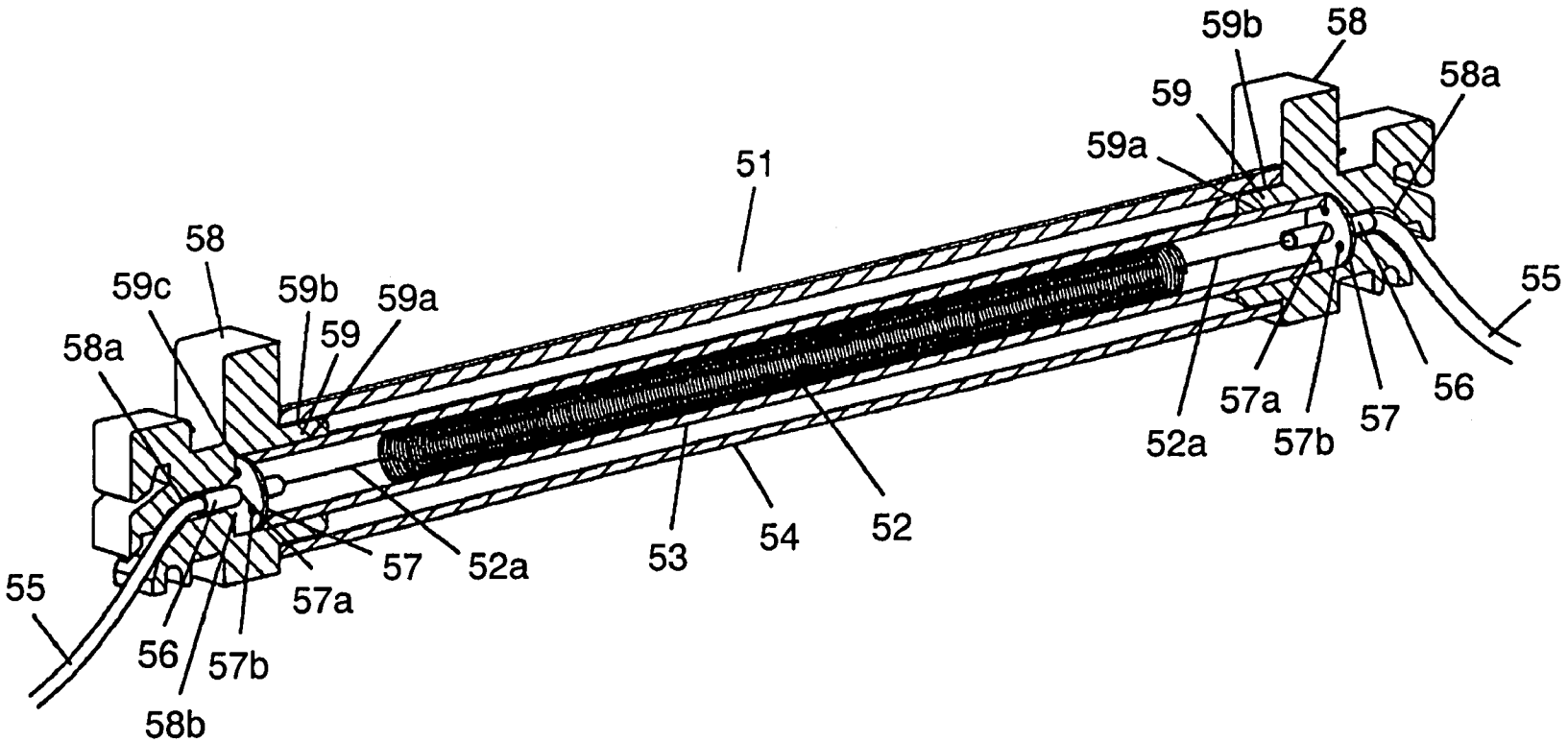
FIG. 2 is a perspective sectional view of the defrosting heater.

FIG. 1 is an essential sectional view of a defrosting heater in a first embodiment of the invention, and FIG. 2 is a perspective sectional view of the defrosting heater.

In FIG. 1 and FIG. 2, reference numeral 51 is a defrosting heater for heating, thawing and removing frost deposits on an evaporator 10, and numeral 52 is a heater wire of resistance wire formed in a coil, having a connection end 52*a* folding and twisting the heater wire by a specified length, instead of coil shape, near the both ends of the heater wire 52. Reference numeral 53 is a first glass tube covering the heater wire 52, having a cylindrical shape of 10.5 mm in outside diameter and 8.5 mm in inside diameter, with both ends being opened.

Reference numeral 54 is a second glass tube covering the first glass tube 53, having a cylindrical shape of 20 mm in outside diameter and 17 mm in inside diameter, with both ends being opened. The overall length of the first glass tube 53 is longer than the overall length of the second glass tube by 17 mm, and when laid down by matching the middle point of each overall length, the end face of the first glass tube 53 projects from the end face of the second glass tube 54 by 8.5 mm.

Reference numeral 55 is a lead wire connected to the heater wire 52, and numeral 56 is a conductive coupling pipe coupling the heater wire 52 and lead wire 55.

Reference numeral 57 is a circular positioning plate, having a central hole 57*a* for inserting the coupling pipe 56, and three air vents 57*b* (1.5 mm in diameter) are disposed around the hole 57*a* at intervals of 120 degrees of central angle from the center of the hole 57*a*. The outside diameter of the positioning plate 57 is same as or slightly smaller than the outside diameter of the first glass tube 53.

To connect the heater wire 52 and lead wire 55, first, the heater wire 52 is inserted into the first glass tube 53, and the coupling pipe 56 is put into the hole 57*a* of the positioning plate 57, and inserted until the positioning plate 57 comes to the central position of the coupling pipe 56. The end portion of the heater wire 52 is inserted from one opening end of the coupling pipe 56, and the end portion of the lead wire 55 is inserted from other opening end of the coupling pipe 56, and the both ends of the coupling pipe 56 are crimped by a tool with care not to deform the positioning plate 57. As a result, the end portion of the heater wire 52 and end portion of the lead wire 55 are coupled together by the coupling pipe 56, and the positioning plate 57 does not slip out by deformation of the both ends of the coupling pipe 56.

Reference numeral 58 is a silicone rubber plug covering the opening end of the first glass tube 53 and second glass tube 54. The plug 58 has a lead wire insertion hole 58*a* for inserting the lead wire 55, and preferably the lead wire 55 should be inserted into the plug 58 before the end portion of the lead wire 55 is crimped by the coupling pipe 56. Reference numeral 58*b* is a gap formed between the positioning plate 57 and plug 58.

The plug 58 has a cylindrical protrusion 59, and the diameter of its inner circumference 59*a* is smaller than the outside diameter of the first glass tube 53 by about 1 mm, and the diameter of the outer circumference 59*b* is same as the inside diameter of the second glass tube 54. Accordingly, when fitting the plug 58 into the opening end of the first glass tube 53 and second glass tube 54, the first glass tube 53 is slightly press-fitted into the inner circumference 59*a*, and the outer circumference 59*b* is slightly expanded, and the outer circumference 59*b* is slightly press-fitted into the second glass tube 54.

The positioning plate 57 is interposed between the end face of the first glass tube 53 and inner wall 59*c* of the cylindrical protrusion 59, and the outer peripheral edge of the positioning plate 57 contacts tightly with the inner circumference 59*a* of the cylindrical protrusion 59. The outside diameter of the positioning plate 57 is same as or slightly smaller than the outside diameter of the first glass tube 53, and therefore the positioning plate 57 will not get inside of the first glass tube 53.

A lead wire insertion hole 58*a* of the plug 58 penetrates through the inner wall 59*c* of the cylindrical protrusion 59, and gas can come in and out from the gap between the lead wire 55 and lead wire insertion hole 58*a* to the inner wall 59*c* of the cylindrical protrusion 59.

The gas coming into the inner wall 59*c* of the cylindrical protrusion 59 passes through the air vents 57*b* of the positioning plate 57, and invades into the first glass tube 53, and contacts with the heater wire 52. The sectional area at an arbitrary position of the clearance between the lead wire insertion hole 58*a* formed in the plug to cover the both end openings of the glass tube 53 and the outside diameter of lead wire 55 passing through this insertion hole 58*a* is 7.1 square millimeters or less.

In the lead wire insertion hole 58*a*, the lead wire 55 and the coupling pipe (junction) are disposed in a total length of at least 6 mm along the insertion hole 58*a*.

Figure 3:
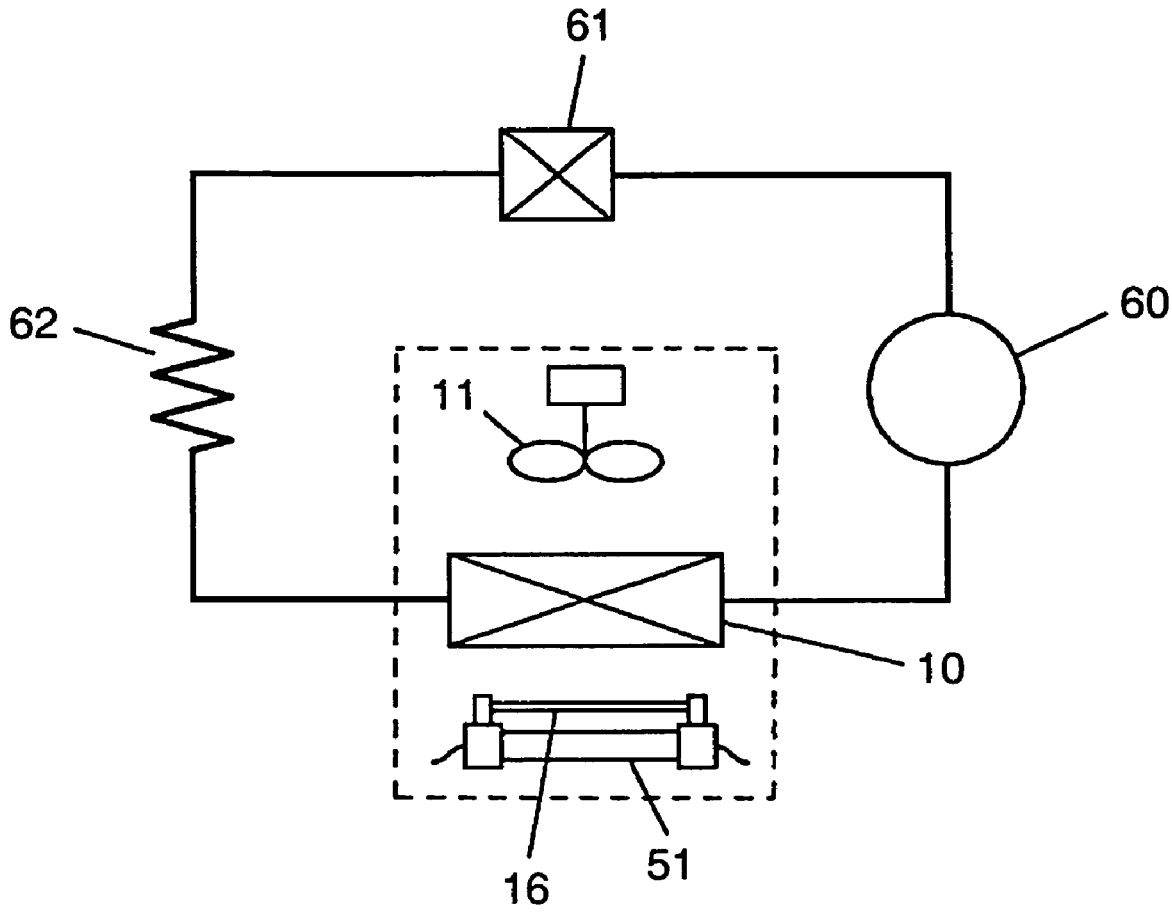
FIG. 3 is a schematic diagram of a refrigerating system of a refrigerator using the defrosting heater.

FIG. 3 is a schematic diagram of a refrigerating system of a refrigerator using the defrosting heater of the first embodiment of the invention, and in FIG. 3, reference numeral 60 is a compressor, 61 is a condenser, and numeral 62 is a pressure reducing mechanism, and the compressor 60, condenser 61, pressure reducing mechanism 62, and evaporator 10 are functionally connected to form a refrigeration cycle, which is packed with flammable refrigerant.

By operation of the compressor 60, the evaporator 10 of the refrigeration cycle is cooled, and by the fan 11 operating simultaneously with the operation of the compressor 60, the compartment air of the refrigerator passes through the cooled evaporator 10, and cold air exchanged of heat with the evaporator 10 is diffused into the compartment. After a specific time of operation of the compressor 60, the operation of the compressor 60 is stopped. At the same time, power is supplied to the heater wire 52 through the lead wire 55, the heater 52 is heated.

As the heater wire 52 generates heat, part of radiant heat ray directly passes to outside, but the remainder is transferred to the first glass tube 53 and second glass tube 54, and the surface of the second glass tube 54 rises to a temperature less than the ignition point of the flammable refrigerant, thereby defrosting the peripheral parts.

In the inner space of the first glass tube 53, at this time, the gas is expanded by temperature rise, and flows outside from the gap between the lead wire 55 and lead wire insertion hole 58*a* through the air vents 57*a* of the positioning plate 57.

In this state, by stopping power supply to the heater wire 52, when cooling is started again, the inside of the first glass tube 53 is reduced in pressure by temperature decline, and the external air surrounding the defrosting heater 51 passes through the gap between the lead wire 55 and lead wire insertion hole 58*a*, and flows into the first glass tube 53 through the air vents 57*a* of the positioning plate 57.

In this situation, in the event of flammable refrigerant existing around the defrosting heater 51, the flammable refrigerant may flow into the inner space of the first glass tube 53, and the flammable refrigerant may be ignited by heat generation of the heater wire 52 upon start of defrosting.

However, if the flammable refrigerant flowing into the first glass tube 53 is ignited, there is no problem in safety so far as the flame does not propagate by passing over the air vents 57*b* of the positioning plate 57, and therefore, in this embodiment, the area of the air vents 57*b* of the positioning plate 57 is defined in a size not allowing the flame to propagate. More specifically, it has been confirmed that there is no danger although the surface temperature of the heater wire 52 reaches up to 590° C. in the atmosphere of the flammable refrigerant existing by 3.0 percent by volume, on condition that the both ends of the first glass tube 53 are closed with the plugs 58 in the normal state, but the positioning plates 57 are removed from both ends of the first glass tube 53 so that the heater is set in open state (opening area being about 57 square millimeters), and 110 V is applied to both ends of the heater wire 52.

Therefore, even if the gas moves through the air vents 57*b* of the positioning plate 57, the sum of three areas of the air vents 57*b* of 1.5 mm in diameter is about 5.3 square millimeters, and there is no risk of explosion. In this specification, it has been confirmed that there is no risk even 170 V is applied to both ends of the heater wire 52 and the surface temperature of the heater wire 52 is raised up to 613° C.

Further, if the air vents 57*b* are assembled into one and the diameter is expanded to 3 mm (an area of 7.1 square millimeters), freedom from risk is confirmed.

Hence, even if there is flammable refrigerant around the defrosting heater 51, accidents due to propagation of flame can be prevented.

In this embodiment, air vents 57*a* are formed in the positioning plate 57, but not limited to this example, for example, without forming air vents 57*a*, the air vents 57*a* may be replaced by a gap formed between the outer peripheral edge of the positioning plate 57 and the inner circumference 59*a* of the cylindrical protrusion 59.

Figure 4:
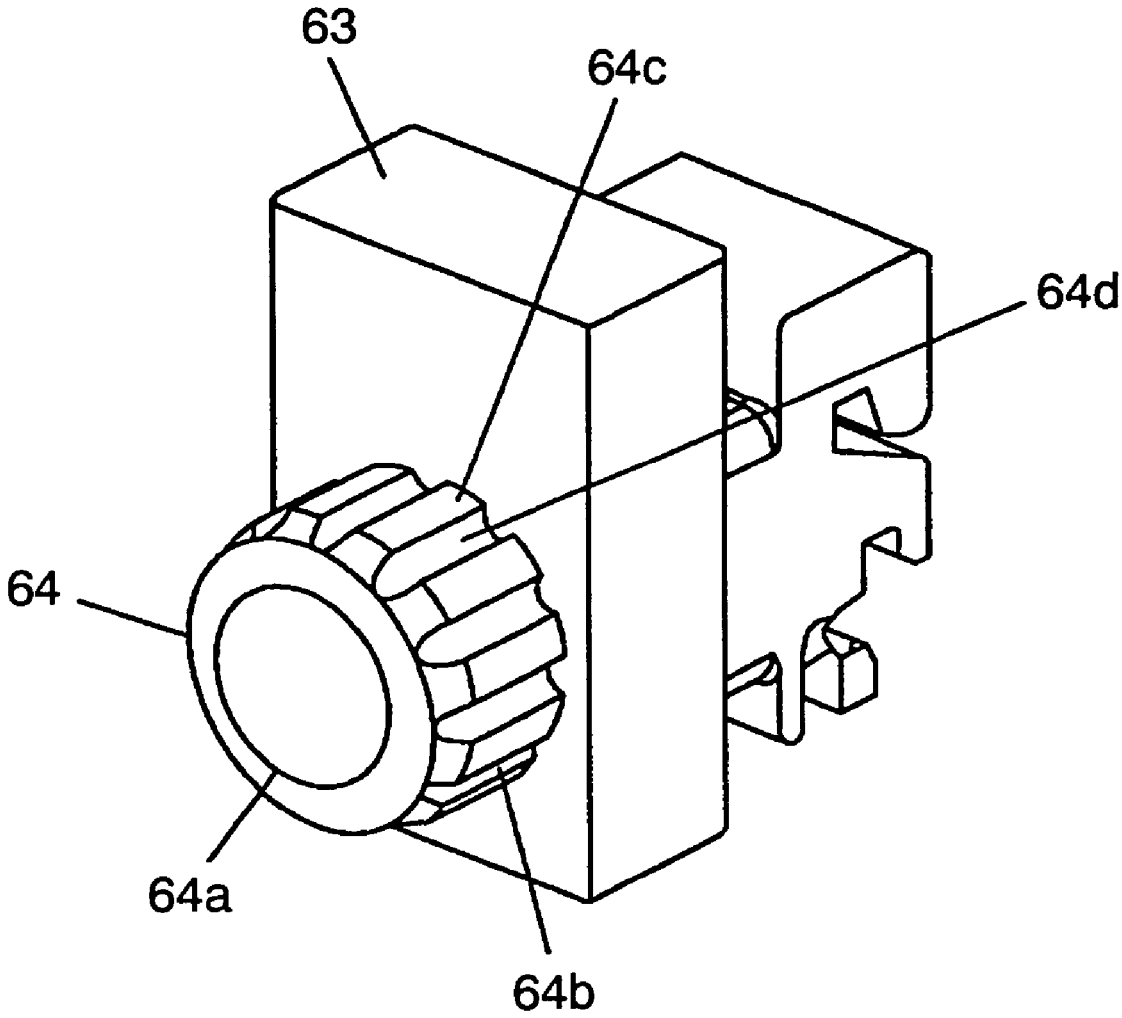
FIG. 4 is a perspective view showing an example of cylindrical protrusion of a plug of the defrosting heater.

Also in the embodiment, the outer circumference of the cylindrical protrusion 59 is circular, but it may be also formed in a corrugated shape, for example, as shown in FIG. 4. In FIG. 4, reference numeral 63 is a plug having a same function as the plug 58, numeral 64 is a cylindrical protrusion provided in the plug 63, an inner circumference 64*a* is slightly press-fitted into the outer circumference of the first glass tube 53, and an outer circumference 64*b* is also slightly press-fitted into the inner circumference of the second glass tube 54. At this time, since the outer circumference 64*b* is formed on corrugation, the compressed top 64*c* moves to the bottom 64*d* to be fitted well, and it is easy to assemble and the working efficiency is enhanced.

Further, when the top 64*c* of the outer circumference 64*b* is compressed and moved to the bottom 64*d*, if a gap is formed between the bottom 64*d* and inner circumference of the second glass tube 54, as far as the size of the gap is set to such an extent not to allow propagation of the flame preliminarily depending on the packed amount of the flammable refrigerant, if power is supplied to the heater wire 52 in order to defrost in an atmosphere filled with leaking flammable refrigerant, the flammable refrigerant invading from the gap between the bottom 64*d* of the outer circumference 64*b* and the inner circumference of the second glass tube 54 is not ignited to propagate the flame to outside, so that the safety is guaranteed.

In the defrosting heater 51 in which the sectional area is 7.1 square millimeters at an arbitrary position in the clearance between the lead wire insertion hole 58*a* formed in the plug covering the both end openings of the glass tube 53 and the outside diameter of lead wire 55 passing through the insertion hole 58*a*. Even if the flammable gas flows into the glass tube 53 and is ignited in the glass tube 53 when the heater is energized, by defining the sectional area of the clearance of the lead wire insertion hole 58*a* at less than a specified value, ignition outside of the glass tube 53 and propagation of flame can be prevented, and the defrosting heater 51 of high safety is realized.

It is a further feature of the defrosting heater 51 that the lead wire 55 and the coupling pipe (junction) 56 are disposed in a total length of at least 6 mm along the insertion hole 58*a* in the lead wire insertion hole 58*a*. Even if the flammable gas flows into the glass tube 53 and is ignited in the glass tube 53 when the heater is energized, by defining the total length of junction 56 of connecting the lead wire 55 and heater wire 52 at more than a specific length, ignition outside of the glass tube 53 and propagation of flame can be prevented, and the defrosting heater 51 of high safety is realized.

Figure 5:
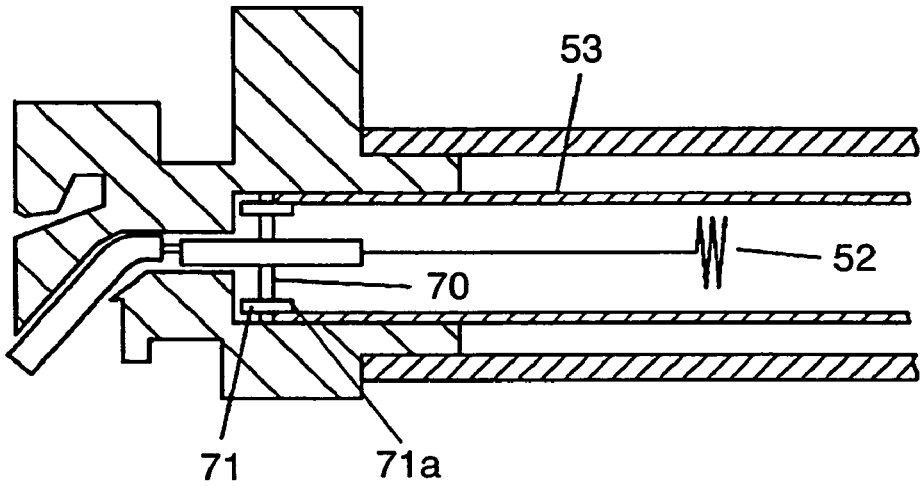
FIG. 5 is an essential sectional view showing an example of a positioning plate of the defrosting heater.

In the embodiment, the positioning plate 57 has air vents 57*b*, but it may be also provided with a sleeve having air vents as shown in FIG. 5. In FIG. 5, reference numeral 70 is a positioning plate having a same function as the positioning plate 57, and a sleeve 71 penetrating through the positioning plate 70 has air vents 71*a*. By properly defining the position of the sleeve 71, the sleeve 71 is slightly press-fitted into the inner circumference of the first glass tube 53, and it is easier to hold the positioning plate 70, so that the working efficiency is enhanced. Moreover, even if the leaking flammable refrigerant is ignited by the heater wire 52, since the air vents 71*a* passing through the sleeve 71 are long in creeping distance, and flame cannot propagate through the air vents 71*a*, so that the safety is guaranteed.

Figure 6:
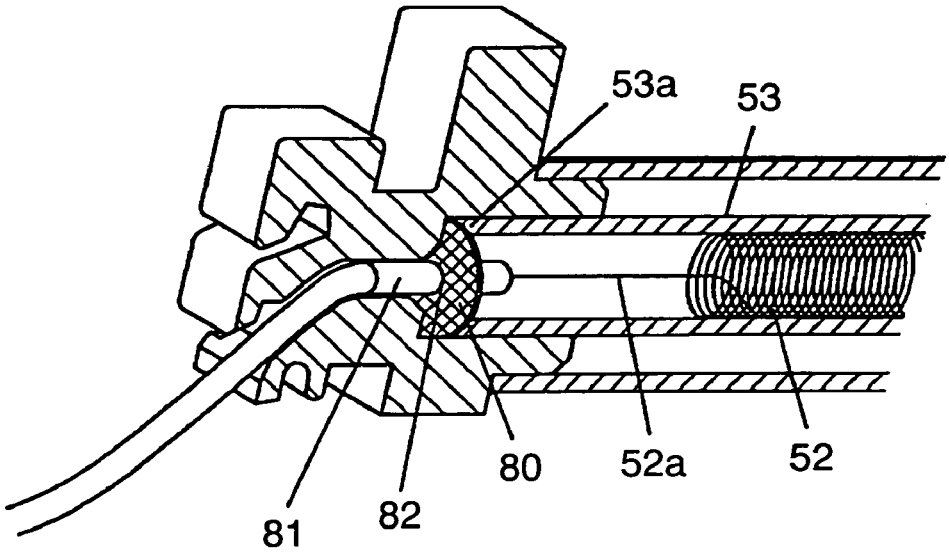
FIG. 6 is an essential perspective sectional view of the defrosting heater.

By adjusting the sleeve length and pore diameter, characteristic of flame propagation can be changed easily. The positioning plate may be formed in a wire mesh structure as shown in FIG. 6. In FIG. 6, reference numeral 80 is a positioning plate having a same function as the positioning plate 57, and is formed of at least 20 meshes of wire in order to prevent flame propagation.

Having a central hole 82 for inserting a coupling pipe 81, the outside of the positioning plate 80 is same as or slightly smaller than the outside diameter of the first glass tube 53. Reference numeral 53*a* is one end face of the first glass tube 53. Reference numeral 52 is a heater wire forming a resistance wire in a coil, having a connection end 52*a* folding and twisting the heater wire by a specified length, instead of coil shape, near the both ends of the heater wire 52. Reference 53 is a first glass tube covering the heater wire 52, having a cylindrical shape of 10.5 mm in outside diameter and 8.5 mm in inside diameter, with both ends being opened. The glass tube end face 53*a* and the coil heater wire 52 keeps a distance of at least 20 mm by way of the connection end 52*a*. As a result, the heater wire 52 as heat source may be set apart from the positioning plate 80, and since the positioning plate 80 is formed of at least 20 meshes of wire, if the heater wire 52 is energized for defrosting in the atmosphere of leaking flammable refrigerant, the invading flammable refrigerant is not ignited to propagate the flame to outside, so that there is no problem in safety.

Still more, since the positioning plate 80 is a wire mesh structure of at least 20 meshes or more, the exhaust resistance when the moisture invading into the glass tube 53 is evaporated and discharged is smaller than the case of air vent structure, and it can be discharged efficiently, so that rusting of heater wire due to stagnant moisture can be prevented.

Figure 7:
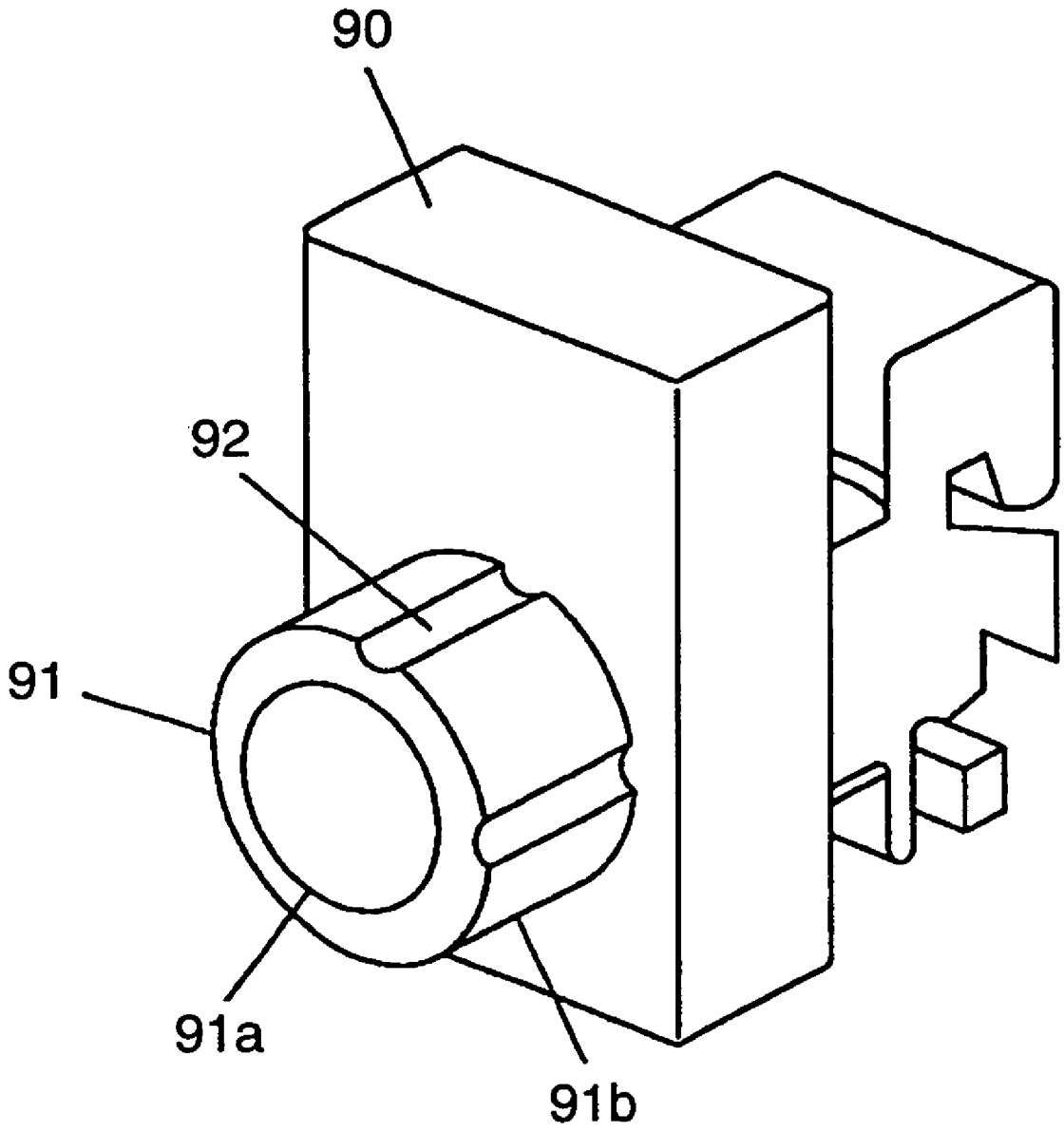
FIG. 7 is a perspective view showing the groove shape of a cylindrical protrusion of the defrosting heater.

In the embodiment, the outer circumference of the cylindrical protrusion 59 is circular, but it may be grooved as shown in FIG. 7. In FIG. 7, reference numeral 90 is a plug having a same function as the plug 58, numeral 91 is a cylindrical protrusion provided in the plug 90, and an inner circumference 91*a* is slightly press-fitted into the outer circumference of the first glass tube 53, and an outer circumference 91*b* is slightly press-fitted into the inner circumference of the second glass tube 54. At this time, a groove 92 is formed in the outer circumference 91*b*, and hence its flexibility is enhanced, and it is easier to assemble and the working efficiency is enhanced.

The sectional area of the groove 92 is 7.1 square millimeters or less, and if a gap equivalent to the sectional area is produced against the inner circumference of the second glass tube 54, when the heater wire 52 is energized for defrosting in an atmosphere of invading flammable refrigerant, the invading flammable refrigerant is not ignited to propagate flame to outside, so that there is no problem in safety.

In the embodiment, the glass tube covering the heater wire 52 of the defrosting heater 51 is a double structure of first glass tube 53 and second glass tube 54, but it may be formed in a single glass tube, and the resistance value of the heater wire and the watt density per unit may be adjusted so that the surface temperature of the glass tube may be less than the ignition temperature of the flammable refrigerant. In the case of single glass tube, the cost can reduced as compared with the double structure.

Second Embodiment

Figure 8:
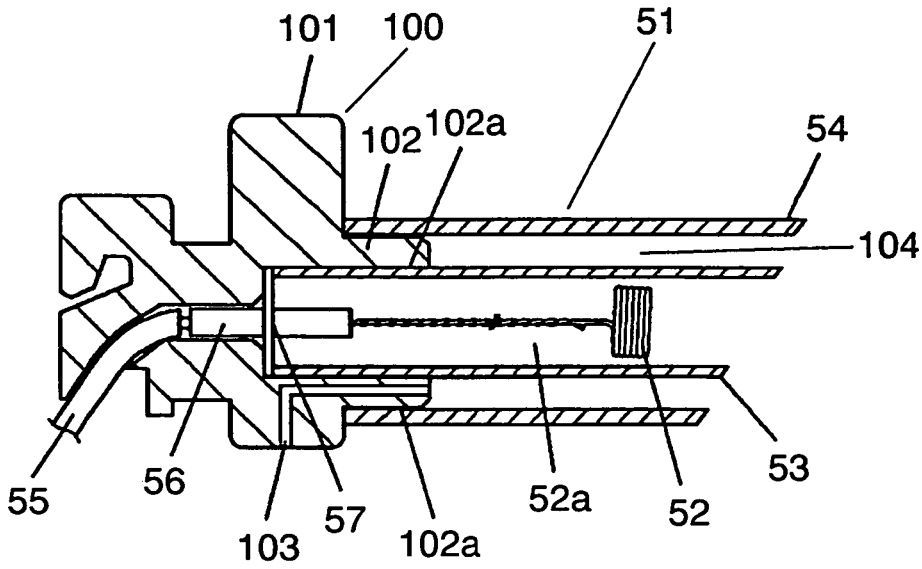
FIG. 8 is an essential sectional view of a defrosting heater in a second embodiment of the invention.

FIG. 8 is an essential sectional view of a defrosting heater in a second embodiment of the invention. Same parts as in the first embodiment are identified with same reference numerals and detailed description is omitted.

In FIG. 8, reference numeral 100 is a plug having same function as the plug 58 in the first embodiment, which comprises a plug main body 101 and a cylindrical protrusion 102 provided in the plug main body 101, and the inner circumference 102*a* of the cylindrical protrusion 102 is slightly press-fitted into the outer circumference of the first glass tube 53, and the outer circumference 102*b* is also slightly press-fitted into the inner circumference of the second glass tube 54.

Reference numeral 103 is a passage penetrating through the plug main body 101 in the longitudinal direction of the cylindrical protrusion 102. Reference numeral 104 is a space formed by the first glass tube 53, second glass tube 54, and plug 100.

In the defrosting heater having such constitution and the refrigerator having this defrosting heater, the operation is described below. By operation of the compressor 60, the evaporator 10 of the refrigeration cycle is cooled, and by the fan 11 operating simultaneously with the operation of the compressor 60, the compartment air of the refrigerator passes through the cooled evaporator 10, and cold air exchanged of heat with the evaporator 10 is diffused into the compartment. After a specific time of operation of the compressor 60, the operation of the compressor 60 is stopped. At the same time, power is supplied to the heater wire 52 through the lead wire 55, and the heater 52 is heated.

As the heater wire 52 generates heat, part of radiant heat ray directly passes to outside, but the remainder is transferred to the first glass tube 53 and second glass tube 54, and the surface of the second glass tube 54 rises to a temperature less than the ignition point of the flammable refrigerant, thereby defrosting the peripheral parts.

In the space 104 formed by the first glass tube 53, second glass tube 54, and plug 100, at this time, the gas is expanded by temperature rise, and flows outside from the passage 103.

In this state, by stopping power supply to the heater wire 52, when cooling is started again, the space 104 is reduced in pressure by temperature decline, and the surrounding external air containing moisture flows into the space 104 through the passage 103.

By supplying power again to the heater wire 52 to heat the heater wire 52, the space 104 is raised in temperature and the moisture is evaporated, and the pressure in the space 104 begins to rise again by the steam. However, since part of the steam flows outside through the passage 103, the pressure rise in the space 104 is alleviated.

By this action, breakage of the first glass tube 53 and second glass tube 54 by pressure rise due to steam evaporation can be prevented, and safety is assured.

If the flammable refrigerant leaks into the refrigerator compartment and the flammable refrigerant flows into the space 104, as explained in the first embodiment, as far as the sectional area of the passage for circulation of the flammable refrigerant is not more than 7.1 square millimeters, if the flammable refrigerant is ignited, the flame does not propagate and explosion does not take place, and hence explosion is prevented by setting the maximum sectional area of the passage 103 at 7.1 square millimeters or less.

Figure 9:
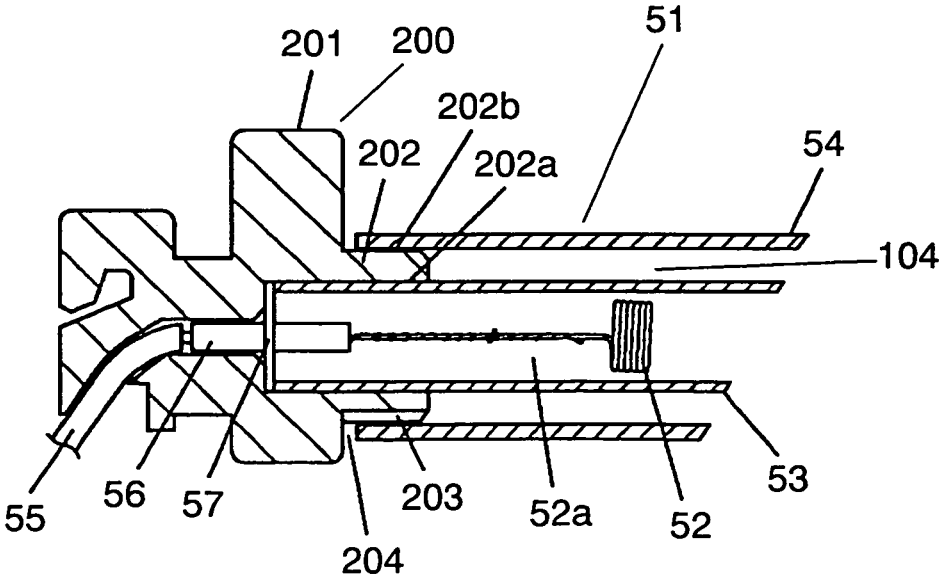
FIG. 9 is a sectional view showing a state of using a plug of other shape in the defrosting heater.

In this embodiment, the passage 103 is a full tubular form, but it may be formed like a groove as shown in FIG. 9. In FIG. 9, reference numeral 200 is a plug having same function as the plug 100, which comprises a plug main body 201 and a cylindrical protrusion 202, and the inner circumference 202*a* of the cylindrical protrusion 202 is slightly press-fitted into the outer circumference of the first glass tube 53, and the outer circumference 202*b* is also slightly press-fitted into the inner circumference of the second glass tube 54. The end face of the second glass tube 54 is stopped at a position about 1 mm apart from the plug main body 201. The outer circumference 202*b* of the cylindrical protrusion 202 has a groove 203 extending in the longitudinal direction from the root to the tip, and a passage 204 is formed by the second glass tube 54 and the groove 203.

Figure 10:
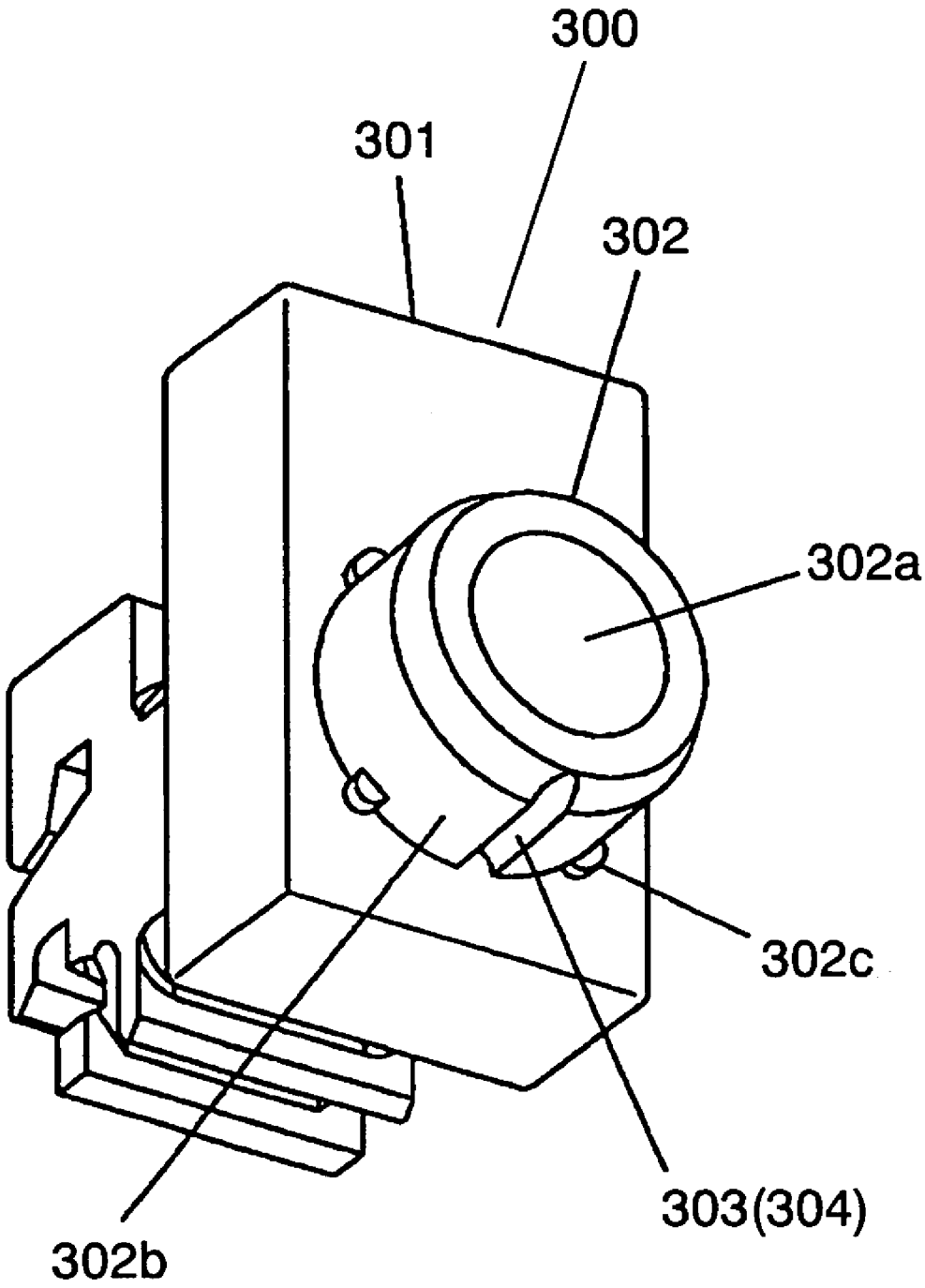
FIG. 10 is a perspective view showing a different shape of the plug of the defrosting heater.
Figure 11:
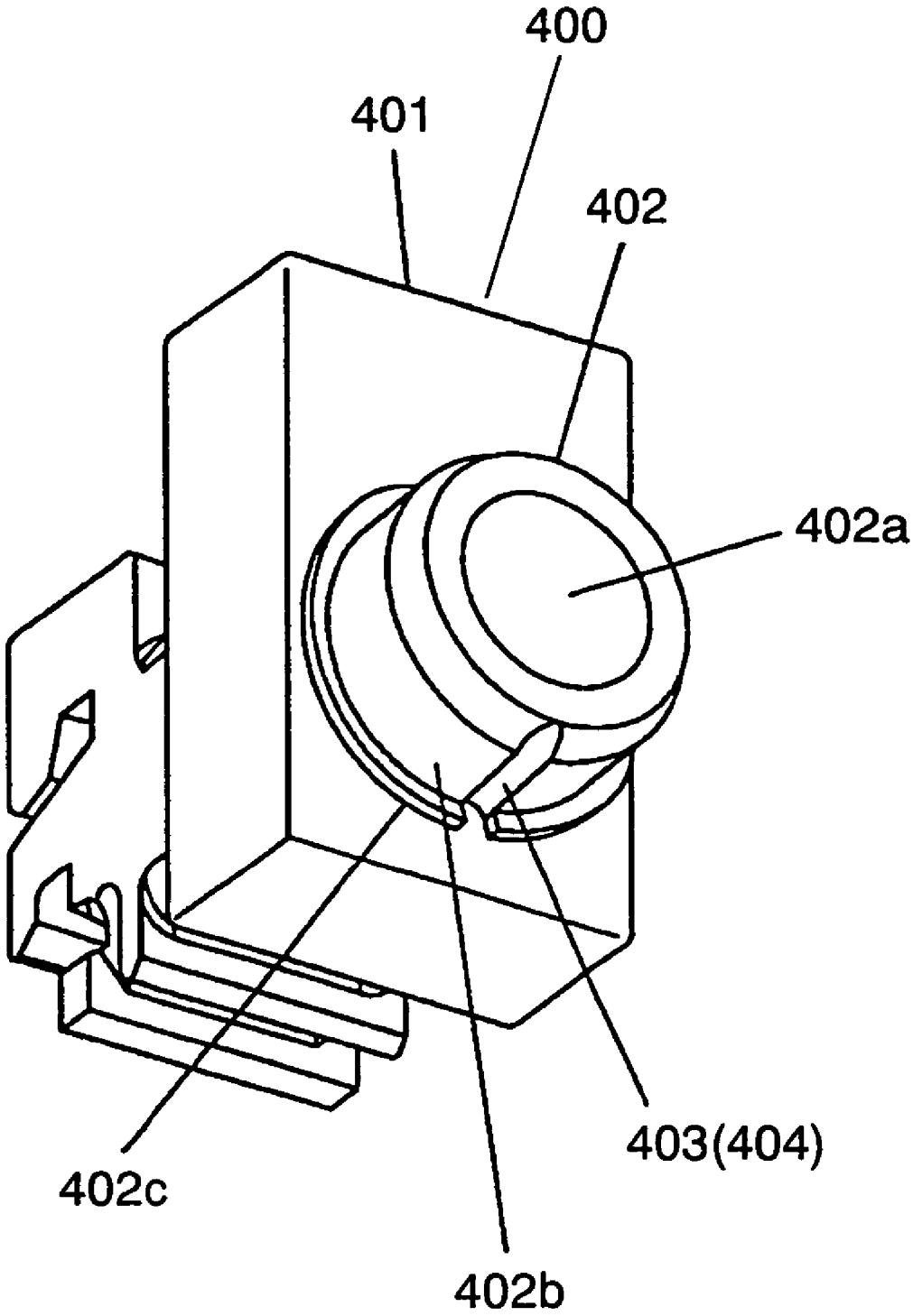
FIG. 11 is a perspective view showing a different shape of the plug of the defrosting heater.

Or the end face of the second glass tube 54 may be stopped at a specified position by forming positioning means as shown in FIG. 10 and FIG. 11.

In FIG. 10, reference numeral 300 is a plug having same function as the plug 100, which comprises a plug main body 301 and a cylindrical protrusion 302, and the inner circumference 302*a* of the cylindrical protrusion 302 is slightly press-fitted into the outer circumference of the first glass tube 53, and the outer circumference 302*b* is also slightly press-fitted into the inner circumference of the second glass tube 54.

Bumps 302*c* are provided at the root of the cylindrical protrusion 302, and the bumps 302*c* are disposed at intervals of 90 degrees around the central axis of the cylindrical protrusion 302, and project from the root of the cylindrical protrusion 302 by 1 mm in the longitudinal direction. Since the end face of the second glass tube 54 is positioned by the bumps 302*c*, the end face of the second glass tube 54 is stopped at a position apart from the plug main body 301 by about 1 mm.

The outer circumference 302*b* of the cylindrical protrusion 302 has a groove 303 extending in the longitudinal direction from the root to the tip, and a passage 304 is formed by the second glass tube 54 and the groove 303. In FIG. 11, reference numeral 400 is a plug having same function as the plug 100, which comprises a plug main body 401 and a cylindrical protrusion 402, and the inner circumference 402*a* of the cylindrical protrusion 402 is slightly press-fitted into the outer circumference of the first glass tube 53, and the outer circumference 402*b* (second outer circumference) is also slightly press-fitted into the inner circumference of the second glass tube 54. The range of 1 mm in the longitudinal direction from the root of the cylindrical protrusion 402 is formed in an outer circumference 402*c* (first outer circumference) larger in diameter than the inside diameter of the second glass tube 54, and the end face of the second glass tube 54 is positioned by a step portion formed between the outer circumference 402*b* and outer circumference 402*c*, and hence the end face of the second glass tube 54 is stopped at a position about 1 mm apart from the plug main body 401.

The outer circumference 402*b* and outer circumference 402*c* of the cylindrical protrusion 402 have a groove 403 extending in the longitudinal direction from the root to the tip, and a passage 404 is formed by the second glass tube 54 and the groove 403.

Figure 12:
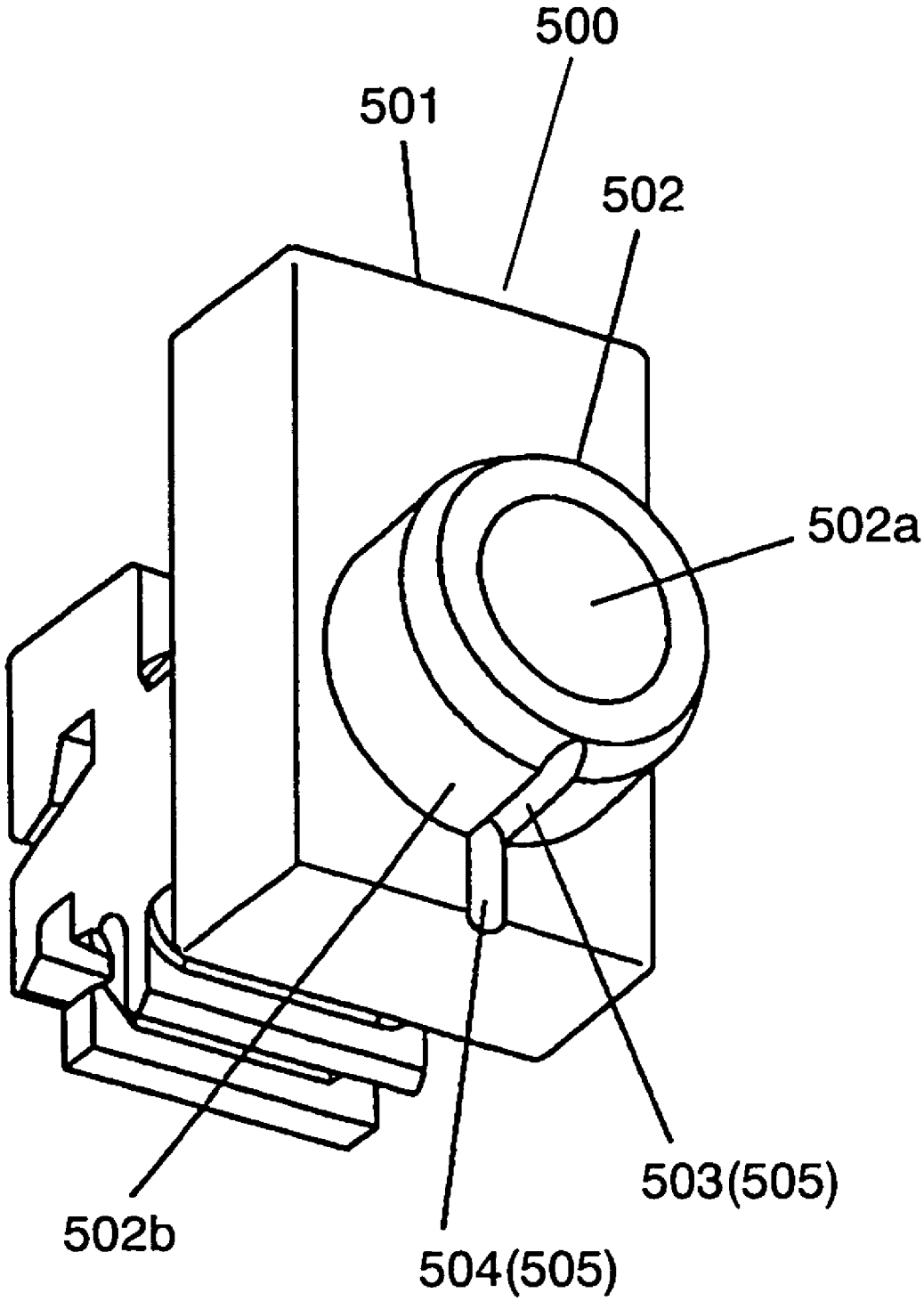
FIG. 12 is a perspective view showing a different shape of the plug of the defrosting heater.

Or, as shown in FIG. 12, a groove may be formed in the plug main body. In FIG. 12, reference numeral 500 is a plug having same function as the plug 100, which comprises a plug main body 501 and a cylindrical protrusion 502, and the inner circumference 502*a* of the cylindrical protrusion 502 is slightly press-fitted into the outer circumference of the first glass tube 53, and the outer circumference 502*b* is also slightly press-fitted into the inner circumference of the second glass tube 54.

The outer circumference 502*b* of the cylindrical protrusion 502 has a groove 503 extending in the longitudinal direction from the root to the tip, the plug main body 501 has a groove 504 extending in the perpendicular direction, crossing with the groove 503, and a passage 505 is formed by the second glass tube 54 and the groove 503 and groove 504.

Thus, by forming grooves in the plug, in the space 104 formed by the first glass tube 53, second glass tube 54, and plug, if the air in the space 104 is expanded by heat generation of the heater wire 52 and the pressure is elevated, the gas flows out through the groove, and the pressure elevation in the space 104 is lessened, and hence rupture of the first glass tube 53 and second glass tube 54 is prevented.

Figure 13:
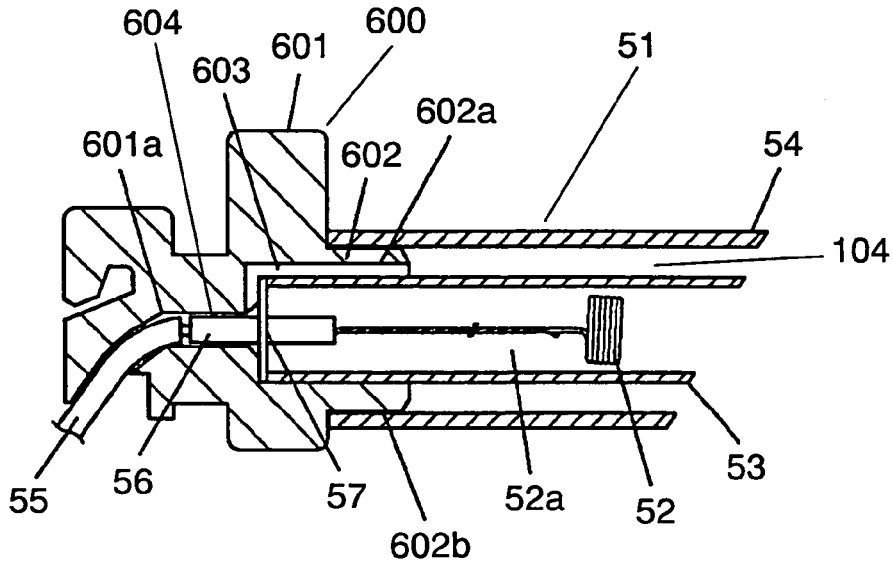
FIG. 13 is a perspective view showing a different shape of the plug of the defrosting heater.

Or, as shown in FIG. 13, a groove may be formed in the inner circumference of the cylindrical protrusion. In FIG. 13, reference numeral 600 is a plug having same function as the plug 100, which comprises a plug main body 601 and a cylindrical protrusion 602, and the inner circumference 602*a* of the cylindrical protrusion 602 is slightly press-fitted into the outer circumference of the first glass tube 53, and the outer circumference 602*b* is also slightly press-fitted into the inner circumference of the second glass tube 54. The inner circumference 602*a* of the cylindrical protrusion 602 has a groove 603 extending in the longitudinal direction from the root to the tip.

The groove 603 is coupled to a lead wire insertion hole 601*a*, and a passage 604 is formed by the first glass tube 54, lead wire insertion hole 601*a* and the groove 603. A plurality of grooves 603 may be also provided in the inner circumference 602*a*. In this configuration, the gas in the spacer 104 can be moved by way of the lead wire insertion hole 601*a* and passage 604, and further since the gas flow inlet of the passage 113 is not visible from outside of the plug main body, and it is preferred from the viewpoint of the design.

Thus, by forming grooves in the plug, in the space 104 formed by the first glass tube 53, second glass tube 54, and plug, if the air in the space 104 is expanded by heat generation of the heater wire 52 and the pressure is elevated, the gas flows out through the groove, and the pressure elevation in the space 104 is lessened, and hence rupture of the first glass tube 53 and second glass tube 54 does not take place, and moreover since the surface of the heater wire 52 and first glass tube 53 is not exposed to the atmosphere, even if the flammable refrigerant leaks in the refrigeration cycle packed with the flammable refrigerant, flame propagation leading to exposure does not take place, and the safety is guaranteed.

Third Embodiment

Figure 14:
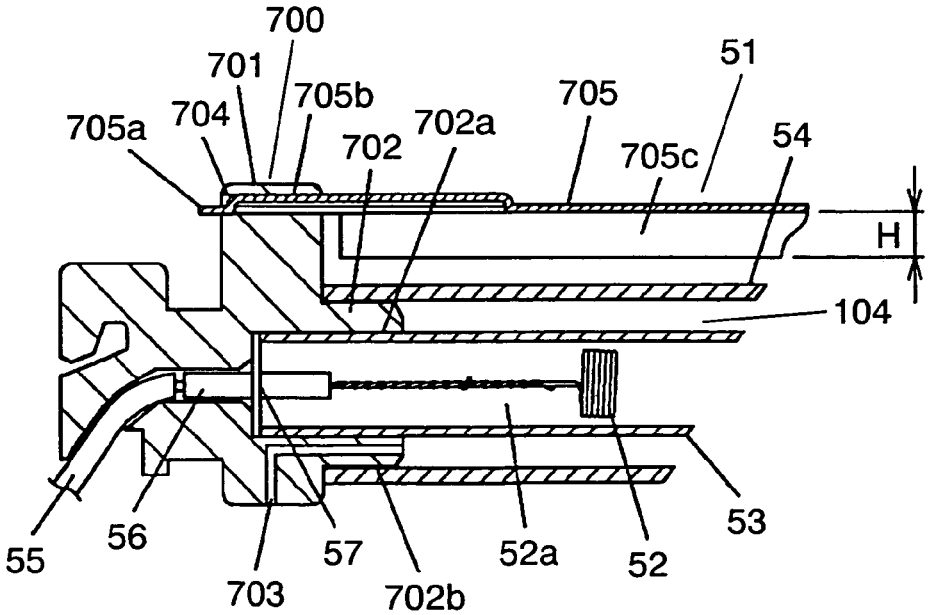
FIG. 14 is an essential sectional view of a defrosting heater in a third embodiment of the invention.
Figure 15:
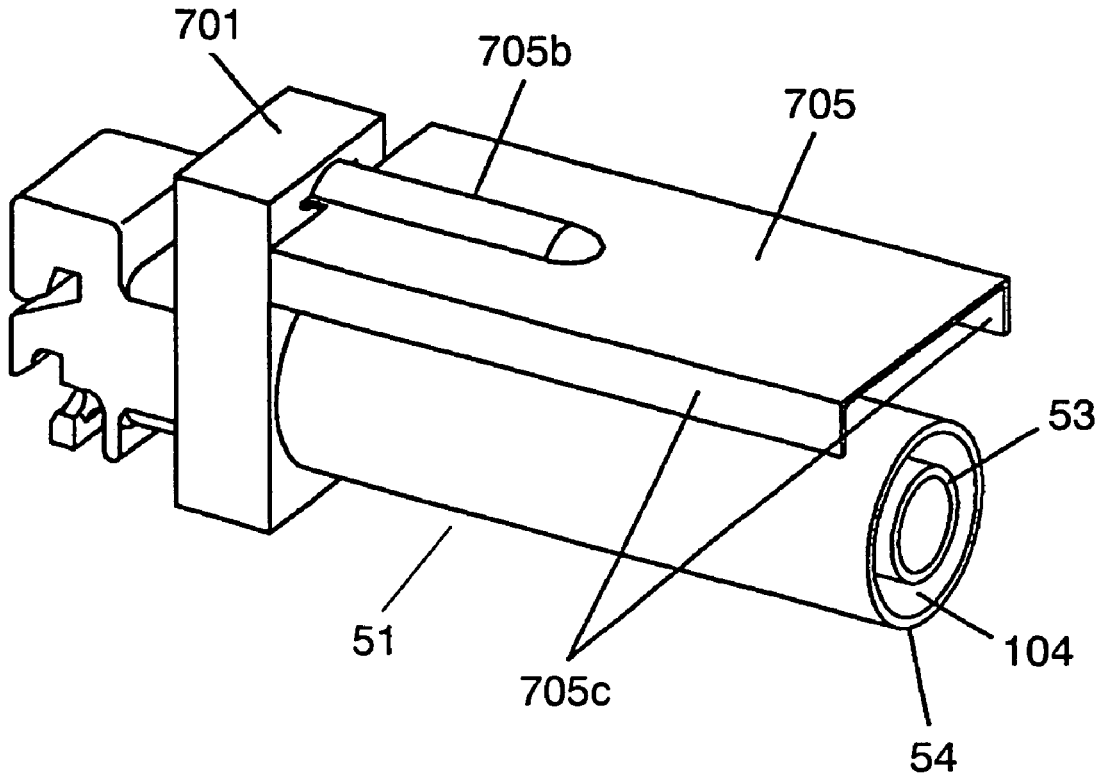
FIG. 15 is an essential perspective view of the defrosting heater.
Figure 16:
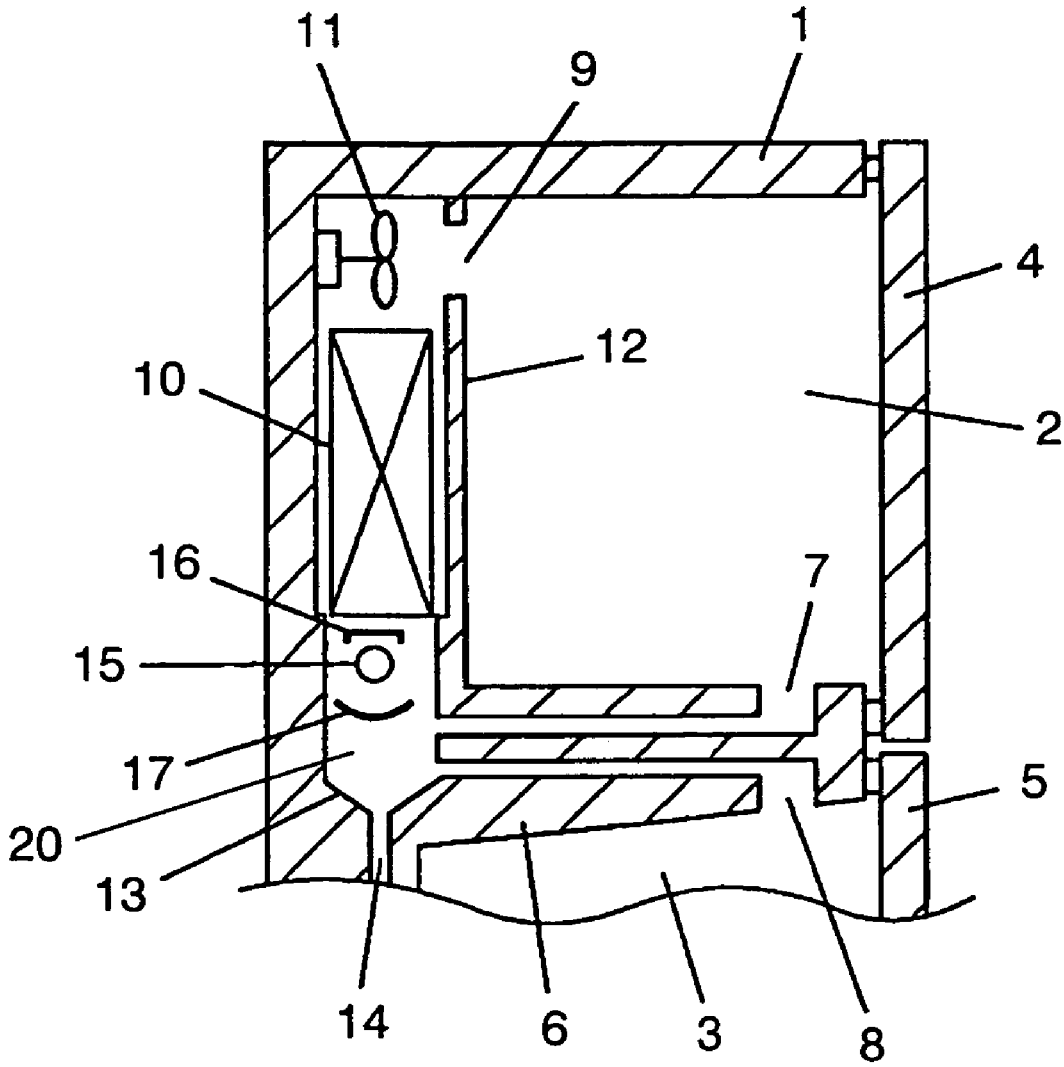
FIG. 16 is a schematic sectional view of a refrigerator having a conventional defrosting heater.

FIG. 14 is an essential sectional view of a defrosting heater in a third embodiment of the invention, and FIG. 15 is an essential perspective view of the defrosting heater of the embodiment. Same parts as in the foregoing embodiments are identified with same reference numerals and detailed description is omitted.

In FIG. 14 and FIG. 15, reference numeral 700 is a plug having same function as the plug 100 in the second embodiment, which comprises a plug main body 701 and a cylindrical protrusion 702 provided in the plug main body 701.

Reference numeral 703 is a passage penetrating through the plug main body 701 in the longitudinal direction of the cylindrical protrusion 702. Reference numeral 104 is a space formed by the first glass tube 53, second glass tube 54, and plug 700.

Reference numeral 705 is a shade held on the plug main body 701 of the plug 700 positioned above in the perpendicular direction of the second glass tube 54, and it prevents water drops falling from the evaporator from hitting directly the surface of the second glass tube 54.

Near the both ends 705*a* of the shade 705, there is a holding part 705*b* formed in a convex shape in a smaller width than in other regions. The holding part 705*b* is inserted into a holding hole 704 provided in the top of the plug main body 701.

At the edge of the shade 705, a draining wall 705*c* is provided along the longitudinal direction, and water dropping from the evaporator is prevented from flowing into the inside of the shade 705.

When the height H of the draining wall 705*c* of the shade 705 is too high, gas is likely to stay between the shade 705 and the second glass tube 54, and the surface temperature of the second glass tube 54 is raised due to temperature rise of the stagnant gas at the time of heat generation of the heater wire 52.

In particular, in the refrigeration cycle packed with flammable refrigerant, in order to assure safety even if the flammable refrigerant leaks, it is preferred to set the surface temperature of the second glass tube 54 at less than the ignition temperature of the flammable refrigerant. Accordingly, the height H of the draining wall 705*c* should be as low as possible so that gas may hardly stay between the shade 705 and second glass tube 54.

In this embodiment, the height H of the draining wall 705*c* is set at 0.5 mm or more to 5 mm or less, and stagnant gas is suppressed, and excessive temperature rise of the surface of the second glass tube 54 is prevented.

Thus, setting the height of the draining wall 705*c* of the shade 705 disposed above in the perpendicular direction of the second glass tube 54, depending on the refrigerant packed in the refrigeration cycle, temperature rise of the surface of the second glass tube 54 can be controlled, and in particular when packed with flammable refrigerant, by setting the height of the draining wall 705*c* at 0.5 mm or more to 5 mm or less, and gas hardly stays between the second glass tube 54 and shade 705, and excessive temperature rise of the surface of the second glass tube 54 is prevented.

Further, since the excessive temperature rise of the surface temperature of the second glass tube 54 can be suppressed, excessive temperature rise in the compartment in defrosting operation can be suppressed, and cooling may be started efficiently after defrosting, so that the energy may be saved.

In the foregoing embodiments, the refrigerator is explained as an example of applying the defrosting heater, but not limited to this, it can be applied in any so-called cold storage having an evaporator, and it can be widely applied in refrigerated show case or automatic vending machine having refrigeration cycle packed with flammable refrigerant.

INDUSTRIAL APPLICABILITY

The defrosting heater of the invention can safely heat and remove frost deposits collected and adhered on the cooler of the refrigeration cycle packed with flammable refrigerant.

The invention claimed is:

1. A defrosting heater for heating and removing frost deposits collected and adhered on a cooler of a refrigeration cycle packed with a flammable refrigerant, comprising a glass tube, a heater wire of metal resistance element installed in the glass tube, a plug covering both end openings of the glass tube, a lead wire penetrating through the plug and connected to the end of the heater wire, and a positioning plate disposed at the junction and held by the plug for preventing the junction of the heater wire and lead wire from moving, wherein a size of the gap formed between the plug and the positioning plate is set depending on the packing amount of the flammable refrigerant and a preset surface temperature of the heater wire.

2. A defrosting heater for heating and removing frost deposits collected and adhered on a cooler of a refrigeration cycle packed with a flammable refrigerant, comprising a first glass tube, a second glass tube installed so as to cover the outer circumference of the first glass tube, a heater wire of metal resistance element installed in the first glass tube, a plug covering both end openings of the first glass tube and second glass tube, a lead wire penetrating through the plug and connected to the end of the heater wire, and a positioning plate disposed at the junction and held by the plug for preventing the junction of the heater wire and lead wire from moving, wherein a size of a gap formed between the plug and the positioning plate is set depending on the packing amount of the flammable refrigerant and a preset surface temperature of the heater wire.

3. A defrosting heater for heating and removing frost deposits collected and adhered on a cooler of a refrigeration cycle packed with a flammable refrigerant, comprising a glass tube, a heater wire of metal resistance element installed in the glass tube, a plug forming a lead wire insertion hole and covering both end openings of the glass tube, a lead wire passing through the lead wire insertion hole and connected to the end of the heater wire, and a positioning plate disposed at the junction of the heater wire and lead wire and held by the plug for preventing the junction from moving, wherein the surface temperature of the glass tube is adjusted so that to be less than the ignition temperature of the flammable refrigerant, and a size of a gap formed by the plug and positioning plate is set so that the flame may not propagate through the gap formed by the plug and positioning plate even if the flammable refrigerant passes through the gap formed by the plug and positioning plate to invade to the heater wire side and ignited.

4. A defrosting heater for heating and removing frost deposits collected and adhered on a cooler of a refrigeration cycle packed with a flammable refrigerant, comprising a first glass tube, a second glass tube installed so as to cover the outer circumference of the first glass tube, a heater wire of metal resistance element installed in the first glass tube, a plug forming a lead wire insertion hole and covering both end openings of the first glass tube and second glass tube, a lead wire passing through the lead wire insertion hole and connected to the end of the heater wire, and a positioning plate disposed at the junction of the heater wire and lead wire and held by the plug for preventing the junction from moving, wherein a size of a gap formed between the plug and the positioning plate is set so that the flame may not propagate through the gap formed by the plug and positioning plate even if the flammable refrigerant passes through the gap formed by the plug and positioning plate to invade to the heater wire side and ignited.

5. The defrosting heater of claim 1 or 2, wherein the sectional area of the gap formed between the plug and positioning plate as seen from the glass tube end side is set at 57 square millimeters or less at an arbitrary position.

6. The defrosting heater of claim 1 or 2, wherein air vents are provided in the positioning plate, and the edge of the positioning plate is kept in tight contact with the inside of the plug, so that the gas is moved inside and outside of the plug through the air vents.

7. The defrosting heater of claim 6, wherein the area of the air vents is 7.1 square millimeters or less.

8. The defrosting heater of claim 2 or 4, wherein the overall length of the first glass tube and the overall length of the second glass tube are different from each other.

9. The defrosting heater of claim 2 or 4, wherein the overall length of the first glass tube is longer than the overall length of the second glass tube.

10. A defrosting heater for heating and removing frost deposits collected and adhered on a cooler of a refrigeration cycle packed with a flammable refrigerant, comprising a glass tube, a heater wire of metal resistance element installed in the glass tube, a plug forming a lead wire insertion hole and covering both end openings of the glass tube, and a lead wire connected to the end of the heater wire through the lead wire insertion hole, wherein the surface temperature of the glass tube is adjusted to be less than an ignition temperature of the flammable refrigerant, and a gap formed by a difference between the lead wire insertion hole and the outside diameter of the lead wire has such a sectional area that the gas in the internal space of the glass tube expanded by temperature rise may flow outside while the atmosphere around the defrosting heater may flow into the glass tube when the inside of the glass tube is reduced in pressure by temperature decline, thereby preventing ignition and propagation of flame outside of the glass tube even if the flammable refrigerant flows into the glass tube and ignited in the glass tube when power is supplied to the heater.

11. A defrosting heater for heating and removing frost deposits collected and adhered on a cooler of a refrigeration cycle packed with a flammable refrigerant, comprising a first glass tube, a second glass tube installed to cover the outer circumference of the first glass tube, a heater wire of metal resistance element installed in the first glass tube, a plug forming a lead wire insertion hole and covering both end openings of the first glass tube and second glass tube, and a lead wire connected to the end of the heater wire through the lead wire insertion hole penetrating through the plug, wherein a gap formed by a difference between the lead wire insertion hole and the outside diameter of the lead wire has such a sectional area that the gas in the internal space of the first glass tube expanded by temperature rise may flow outside while the atmosphere around the defrosting heater may flow into the glass tube when the inside of the first glass tube is reduced in pressure by temperature decline, thereby preventing ignition and propagation of flame outside of the first glass tube even if the flammable refrigerant flows into the first glass tube and ignited in the first glass tube when power is supplied to the heater.

12. The defrosting heater of any one of claims 3, 4, 10, and 11, wherein the sectional area of the gap portion formed by difference between the lead wire insertion hole and outside diameter of lead wire is 7.1 square millimeters or less at an arbitrary position.

13. The defrosting heater of any one of claims 3, 4, 10, and 11, wherein the total length of the lead wire and the junction connecting the lead wire and heater wire is 6 mm or more formed along the insertion hole.

14. The defrosting heater of any one of claims 1 to 4, wherein the positioning plate is provided with a sleeve having air vents, the sleeve penetrates through the positioning plate, and the overall length of the sleeve is 5 mm or more.

15. The defrosting heater of any one of claims 1 to 4, wherein the heater wire has a portion formed in a coil, and this coil portion is set apart from the glass tube end by 20 mm or more, and the positioning plate for preventing the junction of the heater wire and lead wire from moving is formed in a wire mesh structure of 20 meshes or more.

16. The defrosting heater of claim 2 or 4, wherein the plug has a cylindrical protrusion, and the inner circumference of the cylindrical protrusion contacts tightly with the outer circumference of the first glass tube, and the outer circumference of the cylindrical protrusion contacts tightly with the inner circumference of the second glass tube.

17. The defrosting heater of claim 16, wherein the outer circumference of the cylindrical protrusion is corrugated.

18. The defrosting heater of claim 2 or 4, wherein the plug has a cylindrical protrusion, and the inner circumference of the cylindrical protrusion contacts tightly with the outer circumference of the first glass tube, and the outer circumference of the cylindrical protrusion contacts tightly with the inner circumference of the second glass tube, the outer circumference of the cylindrical protrusion has a plurality of grooves, and the sectional area of each groove is 7.1 square millimeters or less.

19. A defrosting heater for heating and removing frost deposits collected and adhered on a cooler of a refrigeration cycle packed with a flammable refrigerant, comprising a first glass tube, a second glass tube installed to cover the first glass tube, a heater wire of metal resistance element installed in the first glass tube, and a plug covering both end openings of the first glass tube and second glass tube, wherein the plug has a passage for passing the gas out of the space when the gas in the space formed by the outer circumference of the first glass tube, inner circumference of the second glass tube and plug is expanded due to temperature rise, and passing the atmosphere into the space when the space is reduced in pressure by temperature decline.

20. The defrosting heater of claim 19, wherein the sectional area of the passage is 7.1 square millimeters or less.

21. The defrosting heater of claim 19, wherein the plug is composed of a cylindrical protrusion and a plug main body holding a root of the cylindrical protrusion, and the cylindrical protrusion is composed of an inner circumference in which the first glass tube is placed and an outer circumference getting into the second glass tube, the outer circumference of the cylindrical protrusion has a groove extending in the longitudinal direction from the root to the tip, and the root of the cylindrical protrusion and the end face of the second glass tube are disposed at a specified spacing when disposing the cylindrical protrusion in the second glass tube, and thereby the groove forms a passage of gas.

22. The defrosting heater of claim 21, wherein bumps are formed to project from the root of the cylindrical protrusion toward the tip by a specified distance, and the end face of the second glass tube are stopped by hitting against the bumps, and thereby the groove forms a passage of gas.

23. The defrosting heater of claim 19, wherein the plug is composed of a cylindrical protrusion and a plug main body holding a root of the cylindrical protrusion, the outer circumference of the cylindrical protrusion is composed of two outer circumferences different in diameter, the root side outer circumference is a first outer circumference, and its diameter is set larger than the inside diameter of the second glass tube, and other outer circumference is a second outer circumference, and its diameter is set same as the inside diameter of the second glass tube, the cylindrical protrusion has a common groove extending in the longitudinal direction from the root of the first outer circumference to the tip of the second outer circumference, and when disposing the cylindrical protrusion in the second glass tube, the end face of the second glass tube is stopped by hitting against a step portion formed between the first outer circumference and second outer circumference, and thereby the groove forms a passage of gas.

24. The defrosting heater of claim 19, wherein the plug is composed of a cylindrical protrusion and a plug main body holding a root of the cylindrical protrusion, the cylindrical protrusion is composed of an inner circumference in which the first glass tube is placed and an outer circumference getting into the second glass tube, the outer circumference of the cylindrical protrusion has a first groove extending in the longitudinal direction from the root to the tip, and the plug main body has a second groove crossing with the first groove at the root of the cylindrical protrusion, and by disposing the cylindrical protrusion in the second glass tube, the grooves form a passage of gas.

25. The defrosting heater of claim 19, wherein the plug has a hole, a cylindrical protrusion composed of an inner circumference in which the first glass tube is placed and an outer circumference getting into the second glass tube, and a groove extending in the longitudinal direction from the root to the tip on the inner circumference of the cylindrical protrusion and communicating with the hole, and the first glass tube, groove, and hole form a passage of gas.

26. The defrosting heater of any one of claims 19 to 25, wherein the outside inlet of the gas passage is directed downward.

27. The defrosting heater of claim 19, wherein the plug is composed of a cylindrical protrusion and a plug main body holding a root of the cylindrical protrusion, the cylindrical protrusion is composed of an inner circumference in which the first glass tube is placed and an outer circumference getting into the second glass tube, the inner circumference of the cylindrical protrusion has a first groove extending in the longitudinal direction from the root to the tip, and a second groove crossing with the first groove at the root of the inner circumference and leading to a lead wire insertion hole for inserting the lead wire, and by disposing the first glass tube in the inner circumference of the cylindrical protrusion, the grooves and the lead wire insertion hole form a passage of gas.

28. The defrosting heater of any one of claims 1, 2, 3, 4, 10, 11, and 19, further comprising a shade disposed above in the perpendicular direction of the glass tube so that the water drops from the cooler may not fall directly on the glass tube surface, wherein a draining wall extending downward is disposed beneath the edge along the longitudinal direction of the shade, and the height of the draining wall is set depending on the type of the refrigerant packed in the refrigeration cycle.

29. The defrosting heater of claim 28, wherein the charged refrigerant is flammable refrigerant, and the height of the draining wall is set at 5 mm or less.

30. A refrigerator having a defrosting heater in any one of claims 1, 2, 3, 4, 10, 11, and 19, wherein said defrosting heater is included in a refrigerator.

* * * * *